US007575475B2

(12) United States Patent
Cheng et al.

(10) Patent No.: US 7,575,475 B2
(45) Date of Patent: Aug. 18, 2009

(54) SHIELDED MICRO USB CONNECTOR

(75) Inventors: Ning-lang Cheng, Tu-Cheng (TW); Yu-hung Su, Tu-Cheng (TW); Sheng-tsung Yuan, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/882,632

(22) Filed: Aug. 3, 2007

(65) Prior Publication Data

US 2009/0036000 A1 Feb. 5, 2009

(51) Int. Cl.
*H01R 13/648* (2006.01)

(52) U.S. Cl. ..... 439/607; 439/610

(58) Field of Classification Search ..... 439/607, 439/610

See application file for complete search history.

(56) References Cited

U.S. PATENT DOCUMENTS

2006/0141845 A1* 6/2006 Hu et al. ..... 439/350
2006/0234530 A1* 10/2006 Chung ..... 439/79

* cited by examiner

*Primary Examiner*—Briggitte R Hammond
*Assistant Examiner*—Vanessa Girardi
(74) *Attorney, Agent, or Firm*—Rosenberg, Klein & Lee

(57) ABSTRACT

A micro USB connector includes a housing, contacts received in the housing and a metal shell shielding the housing. The housing has a body, the body has a front wall, the middle of the front wall extends forward to form a mating portion. The metal shell has a top plate, a bottom plate and two side plates, a receiving space is formed among the top plate, the bottom plate and the two side plates. The metal shell extends towards the receiving space to form at least one blocking portion. The body is received in the rear of the receiving space, the mating portion is received in the front of the receiving space, a front end of the blocking portion is at the front of the front wall of the body. Therefore, the electrical connection between the micro USB connector and the plug is reliable.

8 Claims, 5 Drawing Sheets

SHIELDED MICRO USB CONNECTOR

BACKGROUND OF THE INVENTION

1. Field of the Invention

The present invention relates to a micro USB connector, and more particularly to a micro USB connector capable of preventing a plug pushing a housing of the micro USB connector.

2. The Related Art

Conventionally, a micro USB connector is used to connect a computer and an electronic product such as mobile phone and digital camera, which has a small volume and a multi-function. The traditional micro USB connector includes a housing, a plurality of contacts received in the housing and a metal shell shielding the housing. The housing has a body, which has a front wall, a rear wall, a top wall, a bottom wall and two sidewalls. The front wall protrudes forward to form a plate-shaped mating portion. A plurality of cavities are defined in the mating portion and extends rearward to pass through the body for receiving the contacts therein.

However, when a plug is inserted into the micro USB connector overly, the plug is against the front wall of the body, then the body is easy to be pushed out of the metal shell. In this case, the contact received in the housing has an unsteady connection with a corresponding contact of the plug, therefore, the electrical connection between the micro USB connector and the plug will be unreliable.

SUMMARY OF THE INVENTION

It is an object of the present invention to provide a micro USB connector capable of assuring a reliable electrical connection.

To achieve the above object, the micro USB connector comprises a housing, contacts received in the housing and a metal shell shielding the housing. The housing has a body, the body has a front wall, the middle of the front wall extends forward to form a mating portion, the top wall of the body defines at least one recess passing through the front wall and adjacent to the mating portion. The metal shell has a top plate, a bottom plate and two side plates, a receiving space is formed among the top plate, the bottom plate and the two side plates. The metal shell extends towards the receiving space to form at least one blocking portion. The body is received in the rear of the receiving space, the mating portion is received in the front of the receiving space, the blocking portion is located in the recess, a front end of the blocking portion protrudes forward out of the recess.

As described above, when a mating plug mates with the micro USB connector, the rear of the plug is against the front of the blocking portion to avoid the plug contacting the front wall of the body, then the contact received in the housing has a steady connection with a corresponding contact of the plug, therefore, the electrical connection between the micro USB connector and the plug is reliable.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
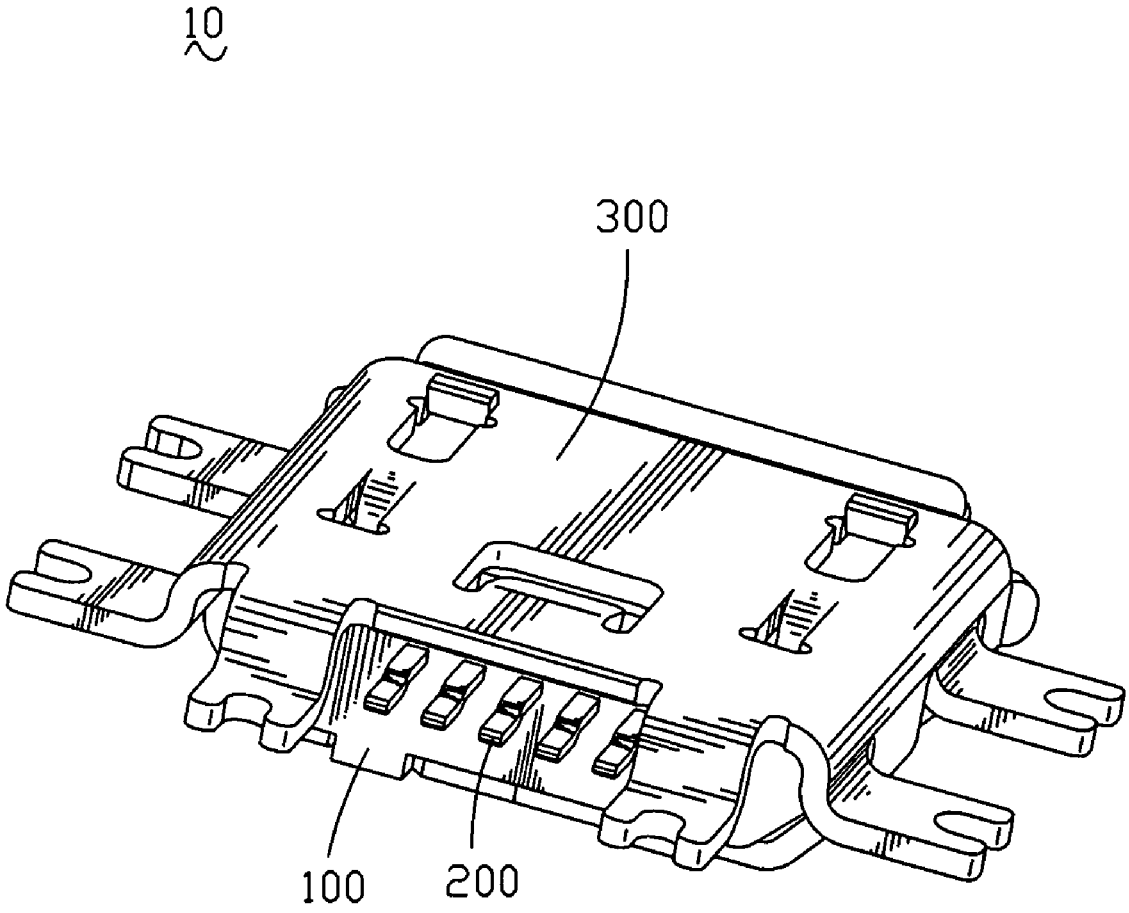
FIG. 1 is a perspective view of a first embodiment of a micro USB connector in accordance with the present invention.
Figure 2:
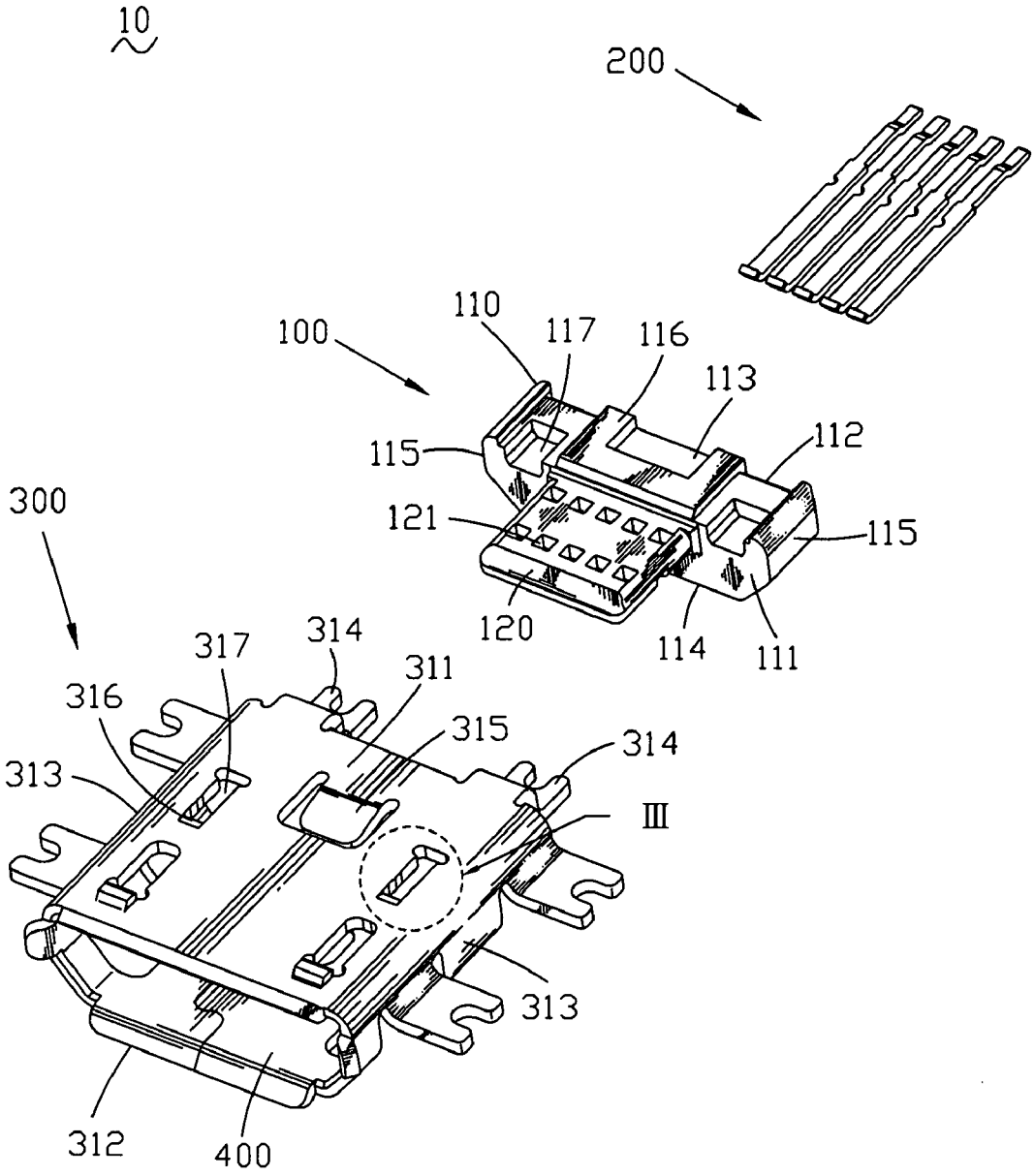
FIG. 2 is an exploded view of the micro USB connector shown in FIG. 1.

Referring to FIGS. 1 and 2, a micro USB connector 10 according to the present invention includes a housing 100, a plurality of contacts 200 received in the housing 100 and a metal shell 300 shielding the body 100.

Figure 3:
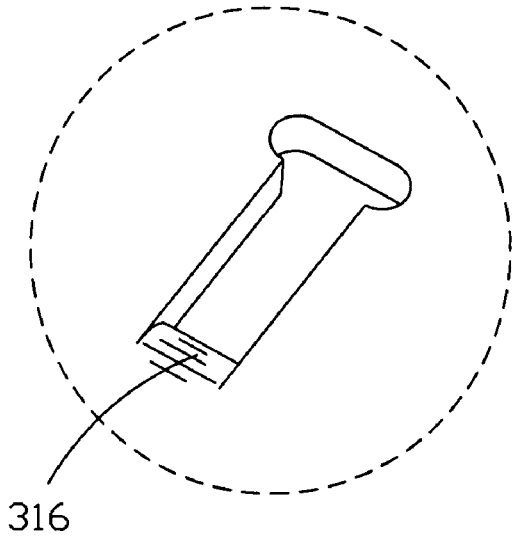
FIG. 3 is a partial enlarged view of the encircled portion labeled III shown in FIG. 2.

Referring to FIGS. 2 and 3, the housing 100 has a body 110, the body 110 has a front wall 111, a rear wall 112, a top wall 113, a bottom wall 114 and two sidewalls 115. The middle of the front wall 111 extends forward to form a plate-shaped mating portion 120. A plurality of cavities (not shown) are defined in the front of the mating portion 120 and extend rearward to pass through the body 110. The mating portion 120 defines two rows of holes 121 therethrough which communicate with the corresponding cavities. The middle of the top wall 113 protrudes upward to form a supporting portion 116, the supporting portion 116 has a base extending transversely and two branches extending rearward from two ends of the base, then a gap is formed therebetween. The top wall 113 defines two recesses 117 at two sides of the supporting portion 116. The recess 117 passes through the front wall 111 and is adjacent to the mating portion 120.

Figure 4:
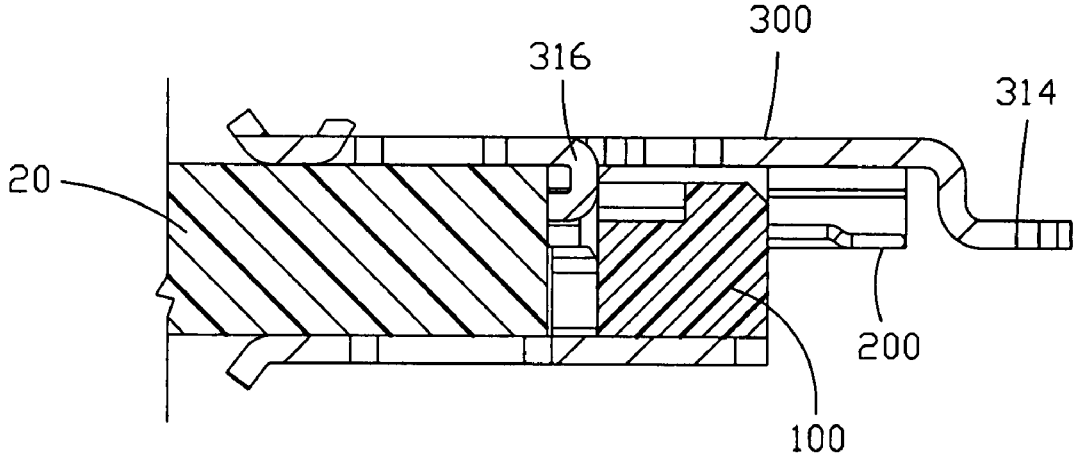
FIG. 4 is a cross-sectional view showing the micro USB connector shown in FIG. 1 mating with a plug.

Please refer to FIGS. 2 and 4, the metal shell 300 has a top plate 311, a bottom plate 312 and two side plates 313, a receiving space 400 is formed among the top plate 311, the bottom plate 312 and the side plates 313. Two sides of the rear end of the top plate 311 extend downward and then rearward to form a soldering portion 314. The middle of the rear of the top plate 311 is cut to form a fixing portion 315, which has a connecting end integrating with the top plate 311 at the rear and a free end at the front. The free end of the fixing portion 315 leans downward a little. The top plate 311 defines two slots 317 extending from front to rear at two sides of the fixing portion 315. The top plate 311 extends downward and then bends forward to form a U-shaped blocking portion 316 from a front edge of the slot 317, the blocking portion 316 is at the front of the fixing portion 315.

Referring to FIG. 4, when the micro USB connector 10 is assembled, the contact 200 is received in the corresponding cavity of the housing 100, a part of the contact 200 stretches into the hole 121. The body 110 is received in the rear of the receiving space 400 of the metal shell 300, the mating portion 120 is received in the front of the receiving space 400. The fixing portion 315 lies in the gap and is against the rear of the base of the supporting portion 116 for fixing the housing 100 in the receiving space 400. The blocking portion 316 is located in the corresponding recess 117 of the body 110, the front of the blocking portion 316 is at the front of the front wall 111 of the body 110.

When a mating plug 20 mates with the micro USB connector 10, the plug 20 is inserted into the receiving space 400 from the front of the receiving space 400. The rear of the plug 20 is against the front of the blocking portion 316 to avoid the plug 20 contacting the front wall 111 of the body 110, then, the contact 200 received in the housing 100 has a steady connection with a corresponding contact of the plug 20, therefore, the electrical connection between the micro USB connector 10 and the plug 20 is reliable.

Figure 5:
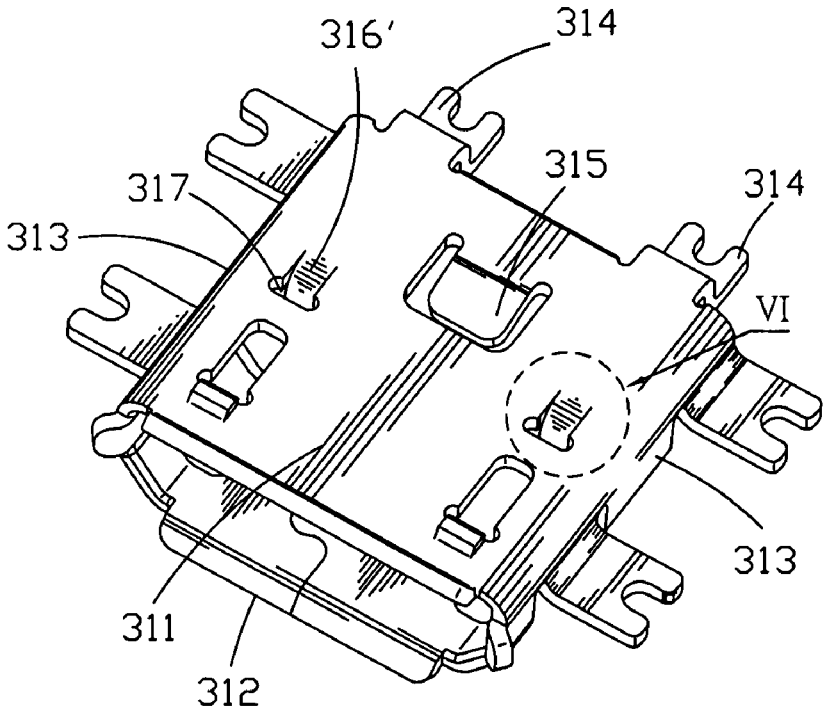
FIG. 5 is a perspective view of a metal shell shown in a second embodiment of the micro USB connector.
Figure 6:
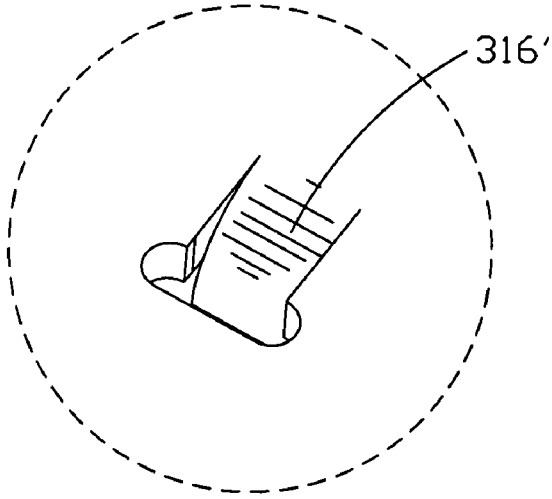
FIG. 6 is a partial enlarged view of the encircled portion labeled VI shown in FIG. 5.

Referring to FIGS. 5 and 6, a second embodiment of the present invention is shown. This embodiment is similar to the first embodiment, the difference between the two embodiments is: the top plate 311 extends downward to form a plate-shaped blocking portion 316' from a rear edge of the slot 317 instead of the blocking portion 316 in the first embodiment, the blocking portion 316' is at the front of the front wall 111 of the body 100, the recess 117 is not necessary to be defined in the top wall 113 of the body 100. When the plug 20 mates with the micro USB connector 10, the blocking portion 318 has the same action and effect as the blocking portion 316'.

Figure 7:
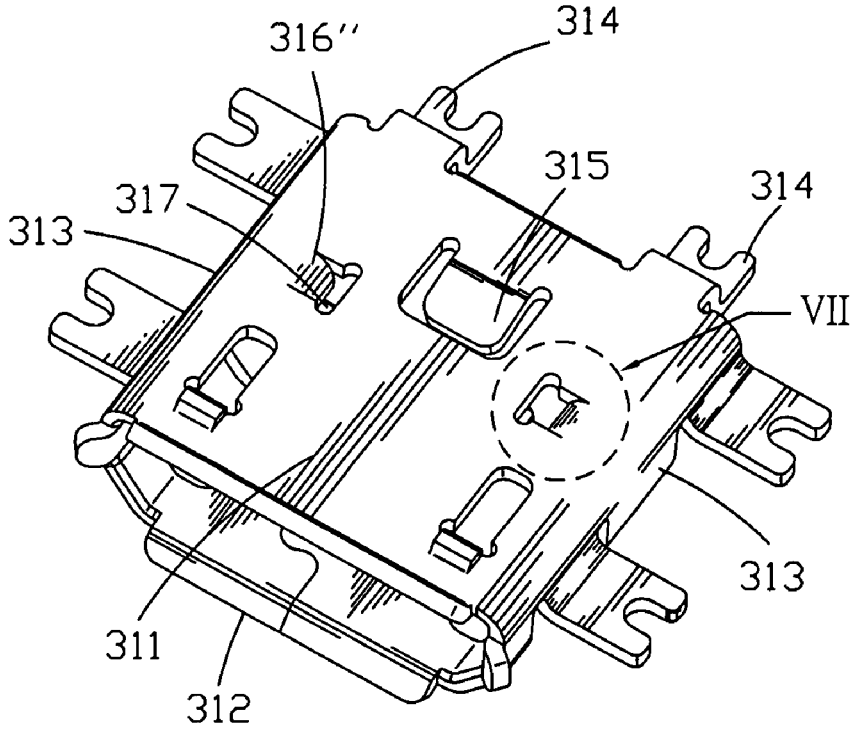
FIG. 7 is a perspective view of a metal shell shown in a third embodiment of the micro USB connector.
Figure 8:
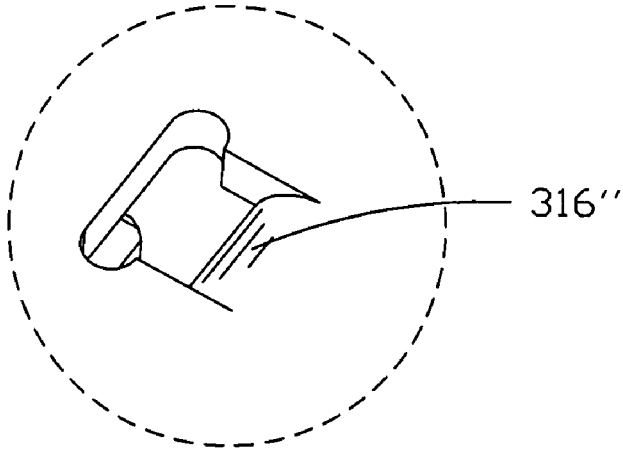
FIG. 8 is a partial enlarged view of the encircled portion labeled VII shown in FIG. 7.

Referring to FIGS. 7 and 8, a third embodiment of the present invention is shown. The difference between the two embodiments is: the top plate 311 extends downward and then bends sideward to form a U-shaped blocking portion 319 from a side edge of the slot 311, the blocking portion 319 is at the front of the fixing portion 315. When the plug 20 mates with the micro USB connector 10, the blocking portion 316" has the same action and effect as the blocking portion 316.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A micro USB connector for mating with a plug, comprising:

a housing having a body, the body having a front wall and a top wall, a middle of the front wall extending forward to form a mating portion, the top wall of the body defining at least one recess passing through the front wall and adjacent to the mating portion;

a plurality of contacts received in the body; and a metal shell having a top plate, a bottom plate and two side plates, a receiving space formed by the top plate, the bottom plate and the two side plates, the top plate having at least one blocking portion extending downwardly into the receiving space, the body being received in a rear of the receiving space, the mating portion being received in a front of the receiving space, the blocking portion being received in the recess of the body to limit a forward location of the body within the receiving space and defining a stop to prevent the mating plug from contacting the front wall of the body.

2. The micro USB connector as claimed in claim 1, wherein the top plate has at least one slot formed therein.

3. The micro USB connector as claimed in claim 2, wherein the blocking portion extends downwardly from a front edge of the slot, the blocking portion having a U-shape contour with a distal end thereof being bent forwardly toward the front of the receiving space to form the stop.

4. The micro USB connector as claimed in claim 2, wherein the blocking portion extends downward and then bends sideward from a side edge of the slot, the blocking portion having a U-shape contour.

5. The micro USB connector as claimed in claim 1, wherein a middle of a rear of the top plate is cut to form a tab that defines a fixing portion, the fixing portion being downwardly inclined to at least partially protrude into the receiving space to lockingly engage the body.

6. The micro USB connector as claimed in claim 5, wherein a middle of the top wall protrudes upwardly to form a supporting portion, the fixing portion being engaged with a rear side of the supporting portion.

7. The micro USB connector as claimed in claim 6, wherein the supporting portion has a base extending laterally between two branches, the branches extending rearwardly from opposing ends of the base to define a space therebetween, the fixing portion being disposed in the and engaged with a rear side of the base of the supporting portion.

8. A micro USB connector for mating with a plug, comprising:

a housing having a body, the body having a front wall and a top wall, a middle of the front wall extending forward to form a mating portion; a plurality of contacts received in the body; and a metal shell having a top plate, a bottom plate and two side plates, a receiving space being formed by the top plate, the bottom plate and the two side plates, the top plate having at least one slot formed therein and a blocking portion extending downwardly from a rear edge of the slot into the receiving space and having a plate-shaped contour, the body being received in a rear of the receiving space, the mating portion being received in a front of the receiving space, the blocking portion serving to limit a forward location of the body within the receiving space and defining a stop to prevent the mating plug from contacting the front wall of the body.

* * * * *